United States Patent [19]

Owens

[11] Patent Number: 4,985,879

[45] Date of Patent: Jan. 15, 1991

[54] INDICATOR LID APPARATUS

[76] Inventor: Connie S. Owens, Rte. 3, Box 68, Cleveland, Okla. 74020

[21] Appl. No.: 470,378

[22] Filed: Jan. 25, 1990

[51] Int. Cl.[5] ..... G04F 1/00; G09F 9/00

[52] U.S. Cl. ..... 368/89; 116/308

[58] Field of Search ..... 368/10, 89, 97, 276, 368/278; 221/1, 2; 116/308

[56] References Cited

U.S. PATENT DOCUMENTS

| | | | |
|---|---|---|---|
| 2,066,183 | 12/1936 | Mehaffey | 116/308 |
| 2,817,451 | 12/1957 | Giles et al. | 116/308 |
| 2,853,182 | 9/1958 | Barnett | 116/308 |
| 4,345,541 | 8/1982 | Villa-Real | 368/89 |
| 4,347,804 | 9/1982 | Villa-Real | 368/89 |

*Primary Examiner*—Vit W. Miska

*Attorney, Agent, or Firm*—Leon Gilden

[57] ABSTRACT

An apparatus including a lid for surroundingly mounting an underlying container. The lid includes a recessed top surface to pivotally mount a first and second arm for indication of a month and associated day appearing on the lid in an annular array about the lid. A locking hub is provided at the axis of the arms, wherein the locking hub is provided with a scalloped lower terminal edge receivable within recesses mounted within the lid. A modification includes the hub formed with a "J" shaped shank receivable within a rectangular slot axially formed through the lid, wherein the shank is rotatable within the slot ninety degrees to depress an associated locking spring formed with edges to embed within the underlying container to securably lock the container to the lid.

6 Claims, 4 Drawing Sheets

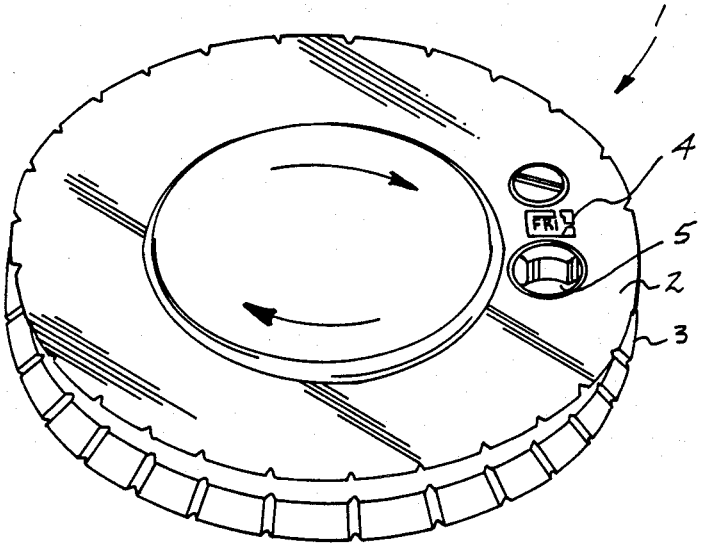
FIG 1 PRIOR ART
FIG 2
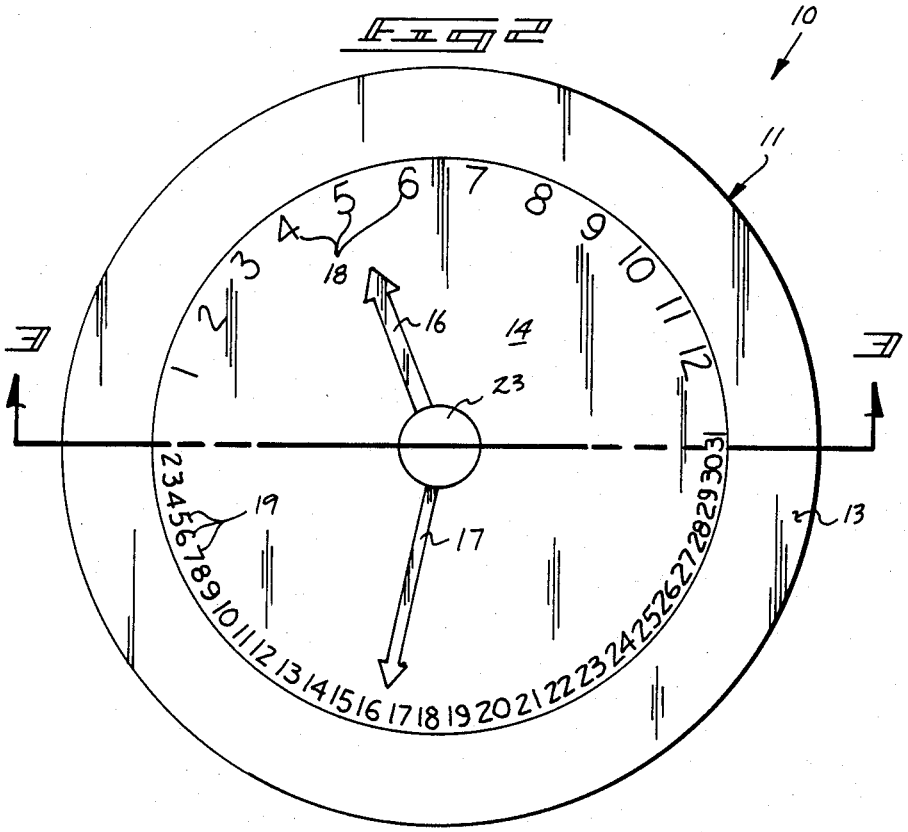

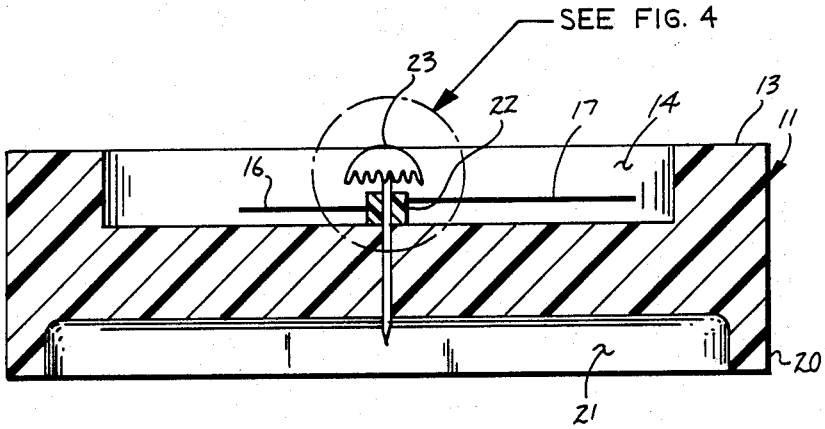
FIG 3
FIG 4
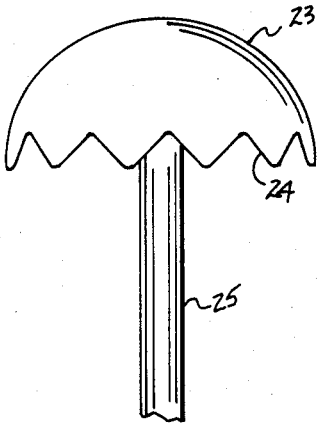

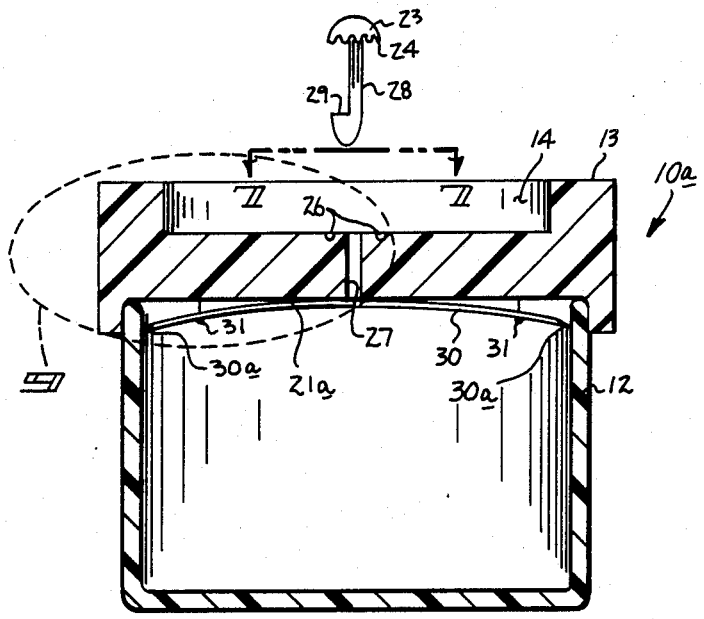
FIG 6
FIG 7
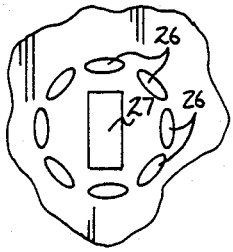
FIG 8
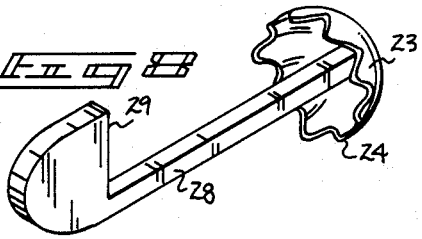
FIG 9
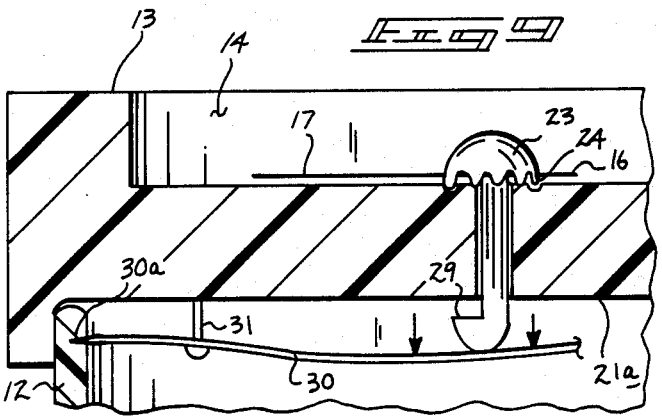

INDICATOR LID APPARATUS

BACKGROUND OF THE INVENTION

1 Field of the Ivention

The field of invention relates to storage container apparatus, and more particularly pertains to new and improved indicator lid apparatus wherein the same provides an indicator organization mounted within a lid of an associated container organization to provide visual indication of positioning of contents within the container and an associated date therewith.

2 Description of the Prior Art

The prior art has provided lid apparatus, and more particularly indicator lid apparatus, for use with associated containers to position a lid on an underlying container. Further, organizations are provided wherein dating of contents within the container is provided. Examples of such organizations are set forth and may be found in U.S. Pat. No. 3,558,008 providing a top lid portion mounted to an underlying support base, wherein the lid utilizes an associated date and underlying chamber to position a pill to be dispensed and associate the dispensing event with the date.

U.S. Pat. No. 4,419,016 to Zoltan provides a device utilizing and indicator list for use with medication, wherein the device is provided with circuitry to indicate a day and time of a dispensing event associated with medication within the container.

U.S. Pat. No. 4,483,626 to Noble provides a container formed with a plurality of compartments and a timer for indication of a timing event in the dispensing of medication from the container organization.

U.S. Pat. No. 3,227,127 to Gayle sets forth a pill dispenser that provides a date in association with a dispensing event from the container.

U.S. Pat. No. 4,127,190 to Sunnen wherein an annular array of pills mounted within the container are associated with indicator indicia exteriorly of the container for association of a date with a pill dispensing event.

As such, it may be appreciated that there is a continuing need for a new improved indicator lid apparatus wherein the same readily and effectively provides an indicator lid apparatus addressing the problems of ease of use and effectiveness in construction to provide visual indication of a freezing or storage event and in this respect, the present invention substantially fulfills this need. SUMMARY OF THE INVENTION In the view of the foregoing disadvantages inherent in the known types of storage container apparatus now present in the prior art, the present invention provides an indicator lid apparatus wherein the same provides for a visual indication of a date when food is positioned within an associated container. As such, the general purpose of the present invention, which will be described subsequently in greater detail, is to provide a new and improved indicator lid apparatus which has all the advantages of the prior art storage container apparatus and none of the disadvantages.

To attain this, the present invention an apparatus including a lid for surroundingly mounting an underlying container. The lid includes a recessed top surface to pivotally mount a first and second arm for indication of a month and associated day appearing on the lid in an annular array about the lid. A locking hub is provided at the axis of the arms, wherein the locking hub is provided with a "J" shaped shank receivable within a rectangular slot axially formed through the lid, wherein the shank is rotatable within the slot ninety degrees to depress an associated locking spring formed with edges to embed within the underlying container to securably lock the container to the lid.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and system for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved indicator lid apparatus which has all the advantages of the prior art storage apparatus and none of the disadvantages.

It is another object of the present invention to provide a new and improved indicator lid apparatus which may be easily and efficiently manufactured and marketed.

It is a further object of the present invention to provide a new and improved indicator lid apparatus which is of a durable and reliable construction.

An even further object of the present invention is to provide a new and improved indicator lid apparatus which is susceptible of a low cost of manufacture with regard to both materials and labor, and which accordingly is then susceptible of low prices of sale to the consuming public, thereby making such indicator lid apparatus economically available to the buying public.

Still yet another object of the present invention is to provide a new and improved indicator lid apparatus which provides in the apparatuses and methods of the prior art some of the advantages thereof, while simultaneously overcoming some of the disadvantages normally associated therewith.

Still another object of the present invention is to provide a new and improved indicator lid apparatus wherein the same provides for convenient storage and locking of a lid relative to underlying container, as well as visual indication of a timing event associated with the positioning of various perishables within the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art container organization.

FIG. 2 is a top orthographic view of the instant invention.

FIG. 3 is an orthographic view taken along the lines 3—3 of FIG. 2 in the direction indicated by the arrows.

FIG. 4 is an orthographic side view taken in elevation of the locking hub as indicated in FIG. 3.

FIG. 6 is an orthographic cross-sectional view of a modified lid utilized by the instant invention.

FIG. 7 is an orthographic sectional view taken along the lines 7—7 of FIG. 6 in the direction indicated by the arrows.

FIG. 8 is an orthographic illustration of the modified locking hub utilized by the instant invention.

FIG. 9 is an orthographic illustration of Section 9 as set forth in FIG. 6.

DESCRIPTION OF THE PREFERRED EMBODIMENT

Figure 5:
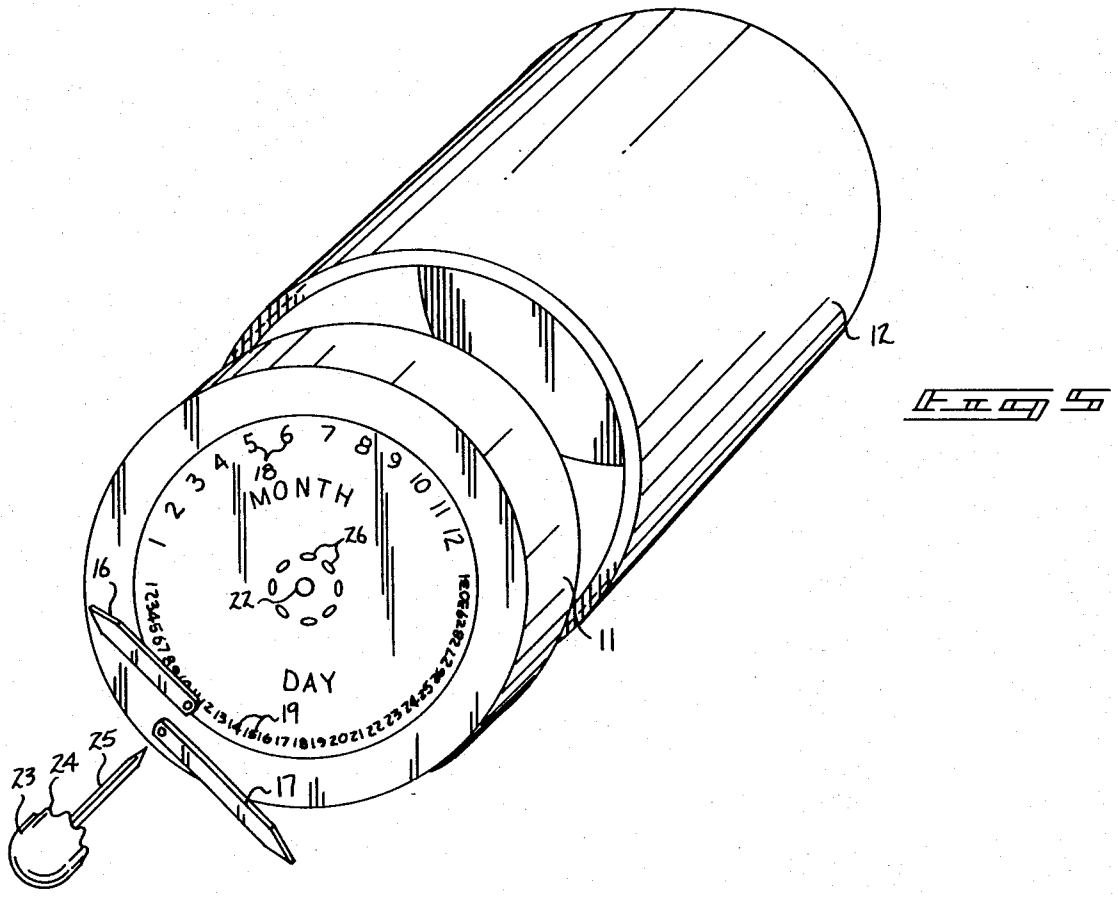
FIG. 5 is an isometric, exploded illustration of the instant invention.

With reference now to the drawings, and in particular to FIGS. 1 to 9 thereof, a new and improved indicator lid apparatus embodying the principles and concepts of the present invention and generally designated by the reference numerals 10 and 10*a* will be described.

FIG. 1 is illustrative of a typical prior art indicator lid and container organization 1, wherein an underlying container 3 includes a rotatably mounted lid 2 for the dispensing of various pills through the opening 5, with an associated indication through a window 4 of the timing event associated with the dispensing of the pills.

More specifically, the indicator lid apparatus 10 of the instant invention essentially comprises a generally annular lid 11 configures to surroundingly mount to an upper end of a container base 12, as illustrated in FIG. 5 for example. The lid 11 includes a top planar perimeter surface portion 13 in surrounding relationship to a recessed central top surface portion 14 recessed below the planar surface defined by the top surface portion 13. A first indicator arm 16 of a first length, and a second indicator arm 17 of a greater second length, are pivotally mounted about a hub member 23. The indicator arms 16 and 17 are respectively positioned for indication of a respective first and second sequence of numbers 18 and 19 arranged in a hemispherical pattern. The first number segments 18 are arranged from one to twelve for association with a month of the year, with the second number sequence 19 directed from one through the numeral thirty-one for indication of a specific date associated with the month of the first number sequence 18.

The lid 11 includes a downwardly depending annular skirt 20 in surrounding relationship to a lower recessed cavity 21 arranged for frictionally receiving the container base 12 therewithin.

As illustrated in FIG. 3, the first and second indicator arms 16 and 17 are rotatably mounted at their lower terminal ends to a support boss 22 that is coaxially arranged relative to the lid 11 on the floor of the recessed surface portion 14. The hub member 23 is defined as an arcuate hemispherical shield defined with a scalloped perimeter edge 24 defined by a predetermined number of projections. The predetermined number of projections 24 are receivable within a like predetermined number of recesses 26 (as illustrated in FIG. 5) to lock the hub member 23 in a predetermined orientation relative to the recessed central top portion 14 and simultaneously lock the respective first and second indicator arms 16 and 17 within the scalloped perimeter edge 24, and more specifically between a pair of spaced projections of the scalloped edge 24 to thereby lock the arms in a desired relationship relative to indication of a respective number of the first and second number sequences 18 and 19. The hub member 23 includes an axially arranged and downwardly depending reciprocatable shaft mounted through the floor of the recessed portion 14.

Reference to FIG. 6 illustrates a modified lid apparatus 10*a* wherein the hub member 23 includes a reciprocatable shaft 28 of a generally "J" shaped configuration. The "J" shaped shaft 28 includes a horizontal abutment surface 29 that is positionable through an associated rectangular bore 27 formed through the web interconnecting the recessed portion 14 and the lower recessed cavity 21. The rectangular bore 27 enables directing of the "J" shaped shaft 28 therethrough to lock the first and second indicator arms 16 and 17 by positioning of the scalloped edge 24 within the recesses 26, as in the embodiment of FIG. 3 for example, but also includes locking of the shaft 28 by abutment of the lower end of the "J" shaped shaft with a diametrically arranged leaf spring 30. The leaf spring 30 provides a dual purpose in biasing the abutment surface 29 against the floor 21*a* of the recess cavity while simultaneously deflecting the leaf spring 30 downwardly to a lowered position to direct opposed pointed terminal ends 30*a* of the leaf spring 30 into the interior side wall of the container base 12. This accordingly locks the hub member 23 in position and simultaneously locks the lid 11 to the container 12. The leaf spring 30 in a raised position is substantially in contact with the floor 21*a* of the lower cavity 21.

Further it is understood that the top planar perimeter surface portion 13 permits stacking of the apparatus without damage to the indicator arms 16 and 17 safely positioned within the recessed top portion 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed as being new and desired to be protected by LETTERS PATENT of the United States is as follows:

1. An indicator lid apparatus in combination with an underlying container, wherein the lid comprises, an annular lid including a planar perimeter top surface and a recessed central cavity oriented medially of the top surface and coaxially of the lid, and a first and second indicator arm rotatably mounted to a hub, wherein the hub is coaxially mounted relative to the central cavity, and a first and second array of numbers associated with the respective first and second indicator arm for indication of a timing event relative to contents positioned within the underlying container, and wherein the central cavity defines a central cavity planar floor, and the lid further includes a lower cavity underlying the central cavity, wherein the underlying cavity includes an underlying floor oriented below and generally parallel to the central floor defined by the central cavity, and wherein the first and second indicator arms are of different lengths for ease of visual recognition of the respective first and second indicator arms, and wherein the hub includes a reciprocatable shaft directed through an aperture coaxially formed through the lid extending through the underlying floor, and the hub further includes a hemispherical shield coaxially mounted to an upper end of the reciprocatable shaft, wherein the hemispherical shield includes a scalloped perimeter edge including a predetermined number of projections spaced about a like predetrmined number of recesses, wherein the first and second indicator arms are latched between the projections within the recesses when the scalloped perimeter edge is positioned downwardly against the central floor.

2. An apparatus as set forth in claim 1, wherein the central floor further includes an annular array of recesses cooperative with the predetermined number of projections to receive and lock the predetermined number of projections within the central floor.

3. An apparatus as set forth in claim 2, wherein the reciprocatable shaft is defined as a "J" shaped configuration, and the aperture is defined as a rectangular slot to receive the "J" shaped configuration therethrough and enable latching of the "J" shaped configuration to the underlying floor.

4. An apparatus as set forth in claim 3 further including a spring member mounted to the underlying floor and positionable in a first position adjacent the underlying floor and spaced from the underlying floor in a second position when the "J" shaped reciprocatable shaft is directed through the aperture.

5. An apparatus as set forth in claim 4 wherein the spring is diametrically aligned and directed across the underlying cavity, and wherein the spring further includes pointed terminal ends, wherein the pointed ends are directed interiorly of an interior surface of an annular skirt defined by the underlying container.

6. An apparatus as set forth in claim 5 wherein the "J" shaped reciprocating shaft includes an abutment surface for abutment with the underlying floor when the "J" shaped shaft is rotated relative to the aperture subsequent to the abutment surface being directed through the aperture.

* * * * *